US006341394B1

(12) United States Patent
Wang

(10) Patent No.: US 6,341,394 B1
(45) Date of Patent: Jan. 29, 2002

(54) SWAY DEVICE FOR A CRADLE

(76) Inventor: Kun Wang, No.56, Min Sheng Street, Feng-Yuan City, 42041 (TW)

( * ) Notice: Subject to any disclaimer, the term of this patent is extended or adjusted under 35 U.S.C. 154(b) by 0 days.

(21) Appl. No.: 09/410,890

(22) Filed: Sep. 29, 1999

(51) Int. Cl.[7] ..... A47D 9/02
(52) U.S. Cl. ..... 5/105; 5/106; 5/99.1
(58) Field of Search ..... 5/101, 105, 106, 5/107, 98.1, 99.1

(56) References Cited

U.S. PATENT DOCUMENTS 5,911,653 A * 6/1999 Cheng ..... 5/99.1
5,956,786 A * 9/1999 Huang ..... 5/105
6,065,163 A * 5/2000 Hung ..... 5/99.1
6,125,483 A * 10/2000 Stroud et al. ..... 5/99.1

* cited by examiner

*Primary Examiner*—Lynne H. Browne
*Assistant Examiner*—James M. Hewitt

(57) ABSTRACT

A sway device for a cradle includes a plurality of sway members respectively connected to a plurality of posts of the cradle and each has an inverse L-shaped foot which includes a vertical portion for enabling the cradle to stand on the ground, a vertical cavity in the top to secure the post of the cradle therein and a transverse portion having two grooved branches perpendicular to each other for respectively pivoting two transverse rods on the lower portion of the cradle. A wobbler extends downward from an underside of the transverse portion of the foot and includes a hollow interior extension, a sector shaped oscillator rotatably pivoted to the lower end of the extension and an elastic plate at a lateral side of the extension for checking the oscillator from rotation.

2 Claims, 8 Drawing Sheets

SWAY DEVICE FOR A CRADLE

BACKGROUND OF THE INVENTION

The present invention relates to cradles and more particularly to a sway device for a cradle which facilitates an adult or a baby himself in swaying the cradle.

A cradle is indispensable to a family. There are various types of cradles on the market and the collapsible type of cradle is most popular. FIG. 1 shows a conventional type of collapsible cradle 10 which includes a foot member 11 under each of the four corners of the cradle, four collapsible transverse rods 12 which include hinge means 13. This type of cradle does not include means to sway the cradle.

SUMMARY OF THE INVENTION

The present invention has a main object to provide a sway device for a cradle to easily allow a cradle, either of the solid or collapsible type to be swayed.

Another object of the present invention is to provide a sway device for a cradle which can be fixed when the cradle is not swaying.

Accordingly, the sway device for a cradle of the present invention comprises four sway members fixed to the four lower corners of a conventional type of cradle. Each of the sway members has an inverse L-shaped foot means and a wobbler which is hingedly suspended from the sway member and has an arcuate bottom standing on the ground, which when an adult or a baby sways the cradle, it begins to swing to and from. If the cradle is not to be swayed the wobbler is fixable so that the foot means therefore stands on the ground.

The present invention will become more fully understood by reference to the following detailed description thereof when read in conjunction with the attached drawings.

DETAILED DESCRIPTION OF THE PREFERRED EMBODIMENT

Figure 1:
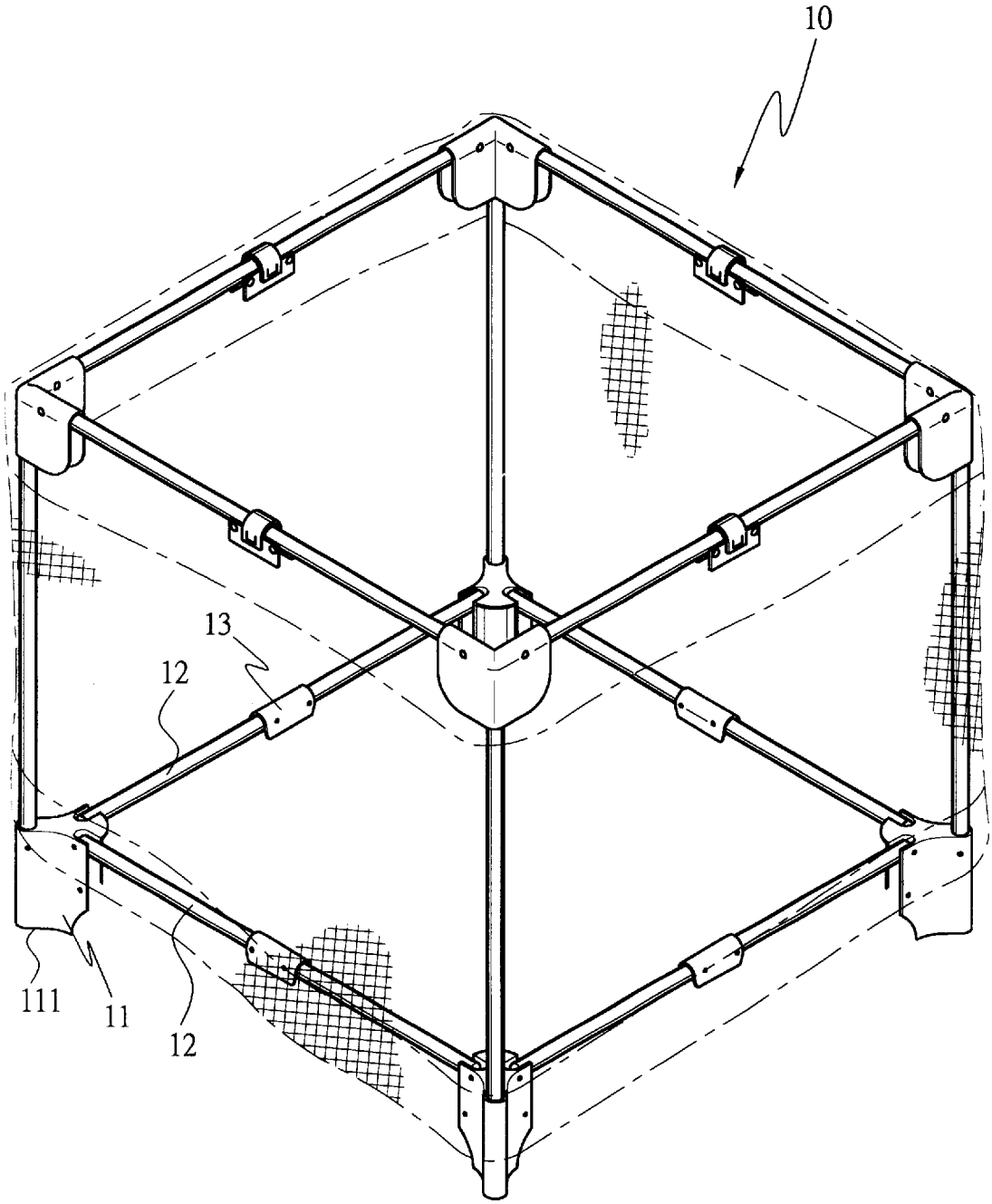
FIG.1 Prior Art
FIG. 1 is a perspective view of a collapsible cradle according to the prior art.
Figure 2:
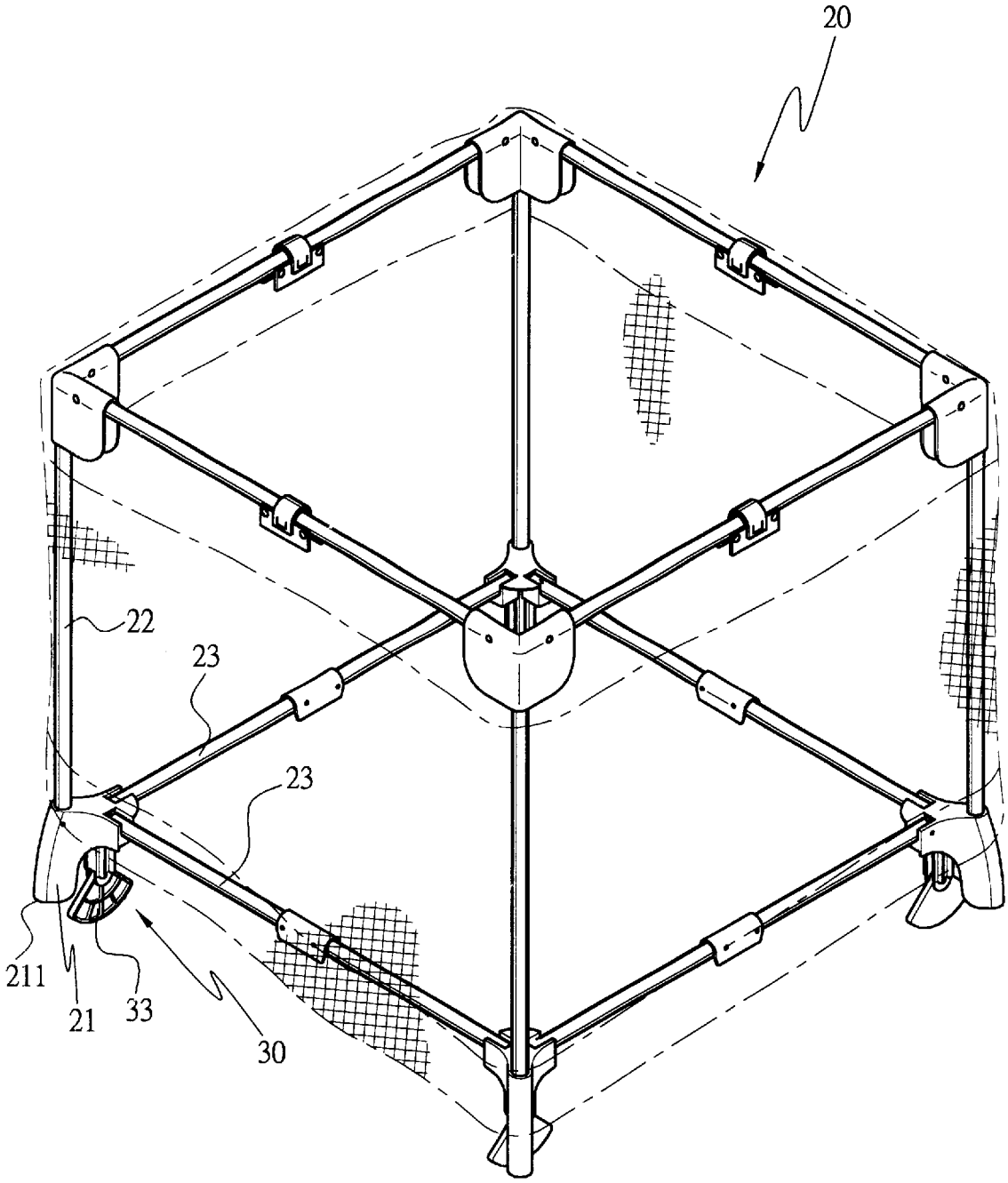
FIG. 2 is a perspective view of a preferred embodiment according to the present invention.
Figure 3:
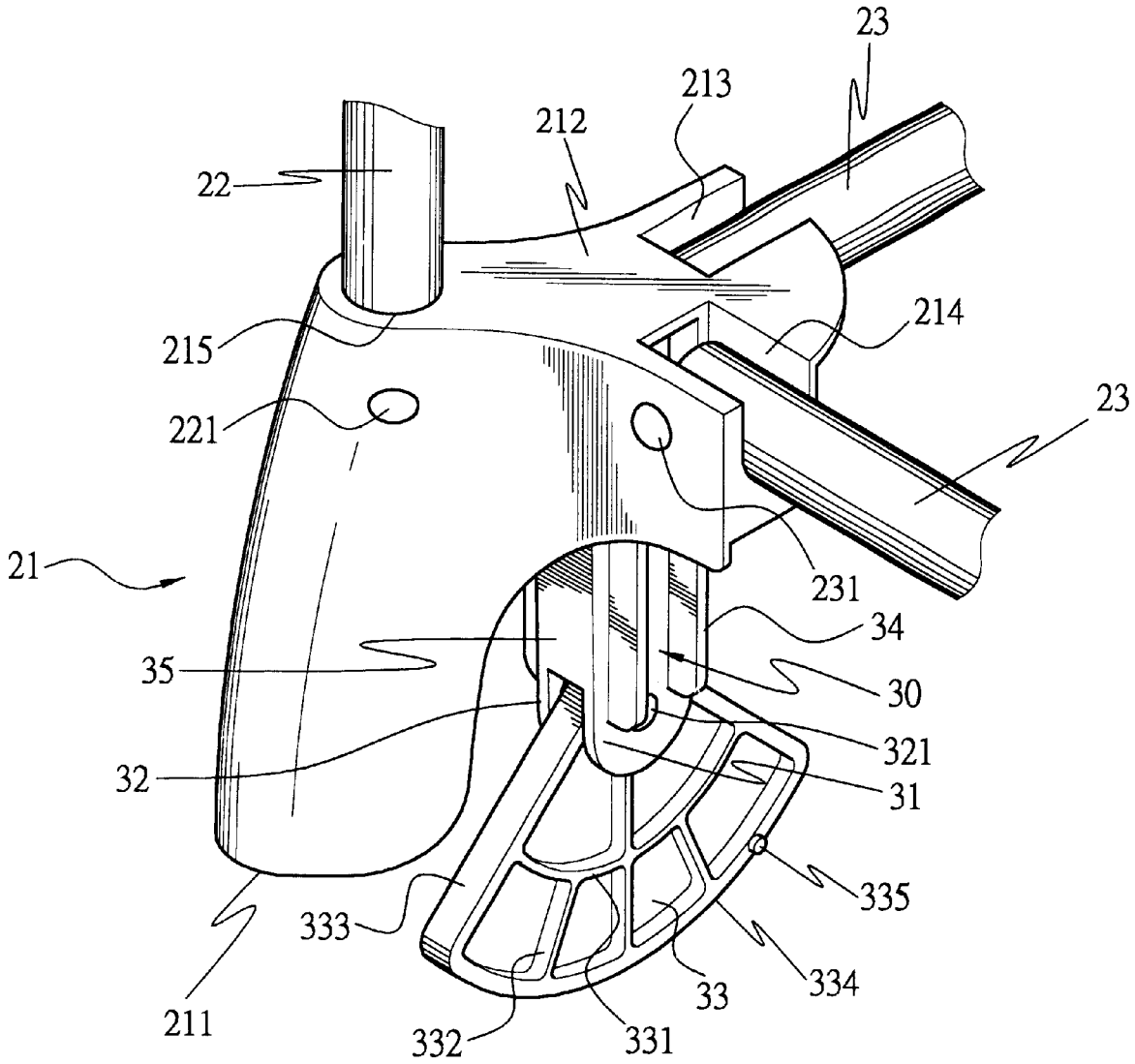
FIG. 3 is a perspective view to show the sway device of the present invention.
Figure 4:
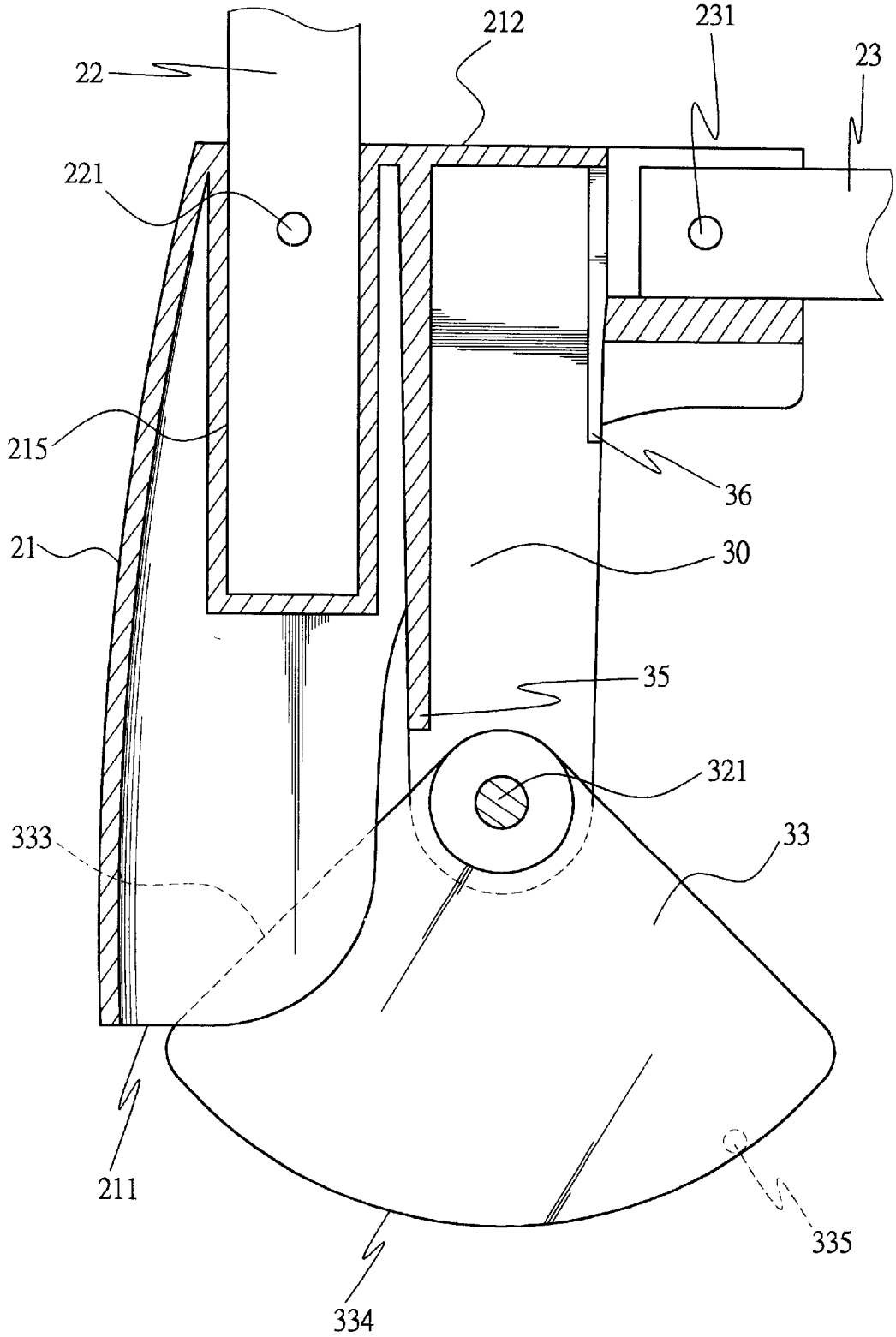
FIG. 4 is a sectional view of FIG. 3.

With reference to FIGS. 2 and 3 of the drawings, the sway device for a cradle of the present invention comprises a plurality of sway members respectively disposed under four vertical posts of a collapsible cradle 20. Each of the sway members includes an inverse L-shaped foot means 21 which has a vertical portion 211 for enabling the cradle to stand on the ground, a transverse portion 212 having a pair of grooved branches 213 and 214 perpendicular to each other for allowing a pair of lower transverse rods 23 of the cradle 20 to pivot by rivets 231, a vertical cavity 215 in the top of the vertical portion for securing a vertical post 22 of the cradle 20 therein by rivet 221, and a wobbler extending downward from an underside of the transverse portion 212 of the foot means 21. The wobbler 30 includes a hollow interior extension 31 integrated with the transverse portion 212, and a roughly sector shaped oscillator 33 pivoting on the extension 31. The extension 31 has a lug 32 for pivotally connecting the oscillator 33 by rivet 321, a plurality of longitudinal ribs 34 on opposite outer surfaces for reinforcement, a lateral wall 35 and an elastic plate 36 on the other side opposite to the lateral wall 35 (as shown in FIG. 4). The sector shaped oscillator 33 has a plurality of arcuate ribs 331, a plurality of radial ribs 332, a pair of lateral sides 333, an apron 334 on an outer surface of which is a projection 335.

Figure 5:
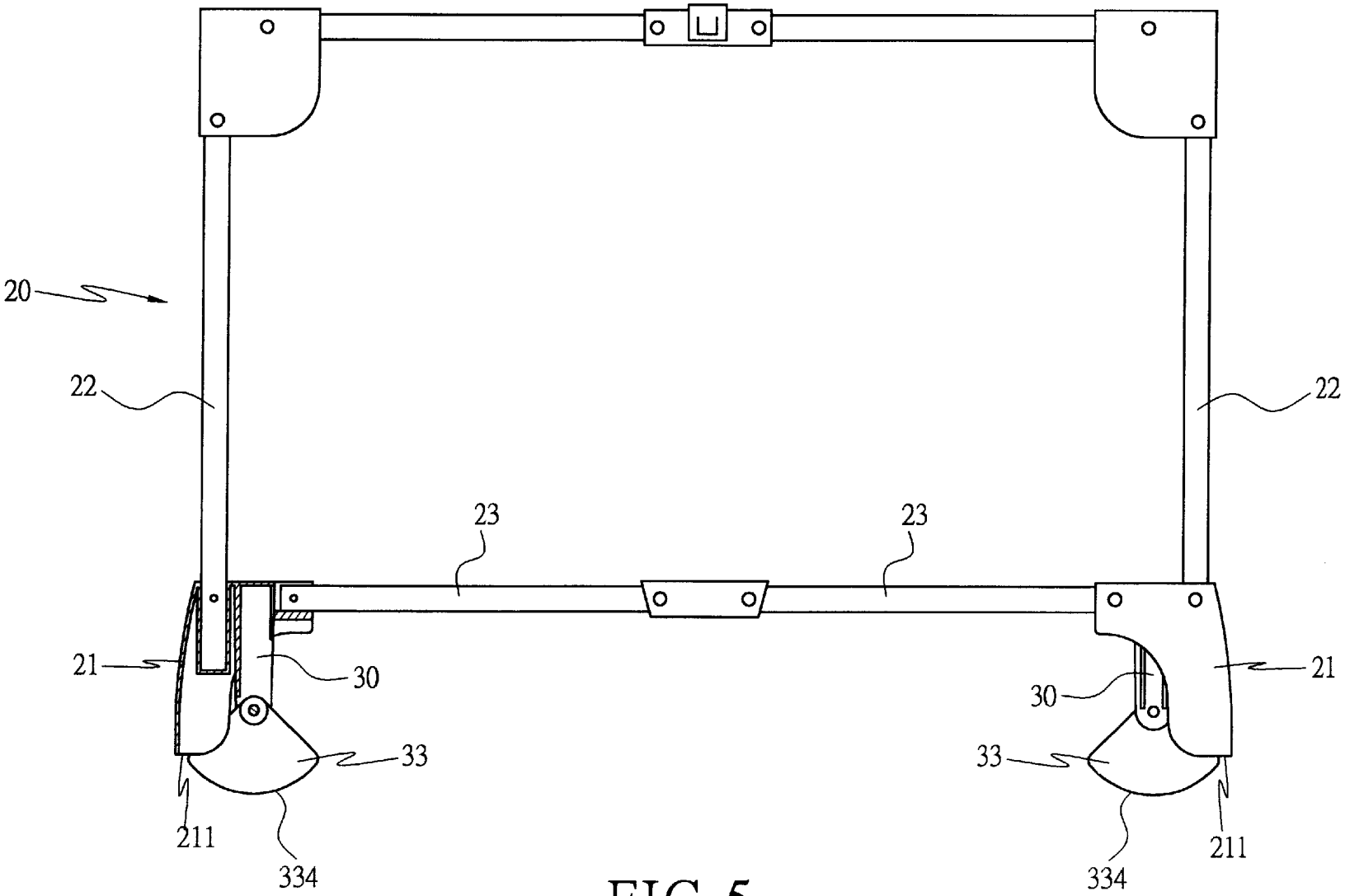
FIG. 5 is an elevational view to show the sway device under the foot of a cradle.
Figure 6:
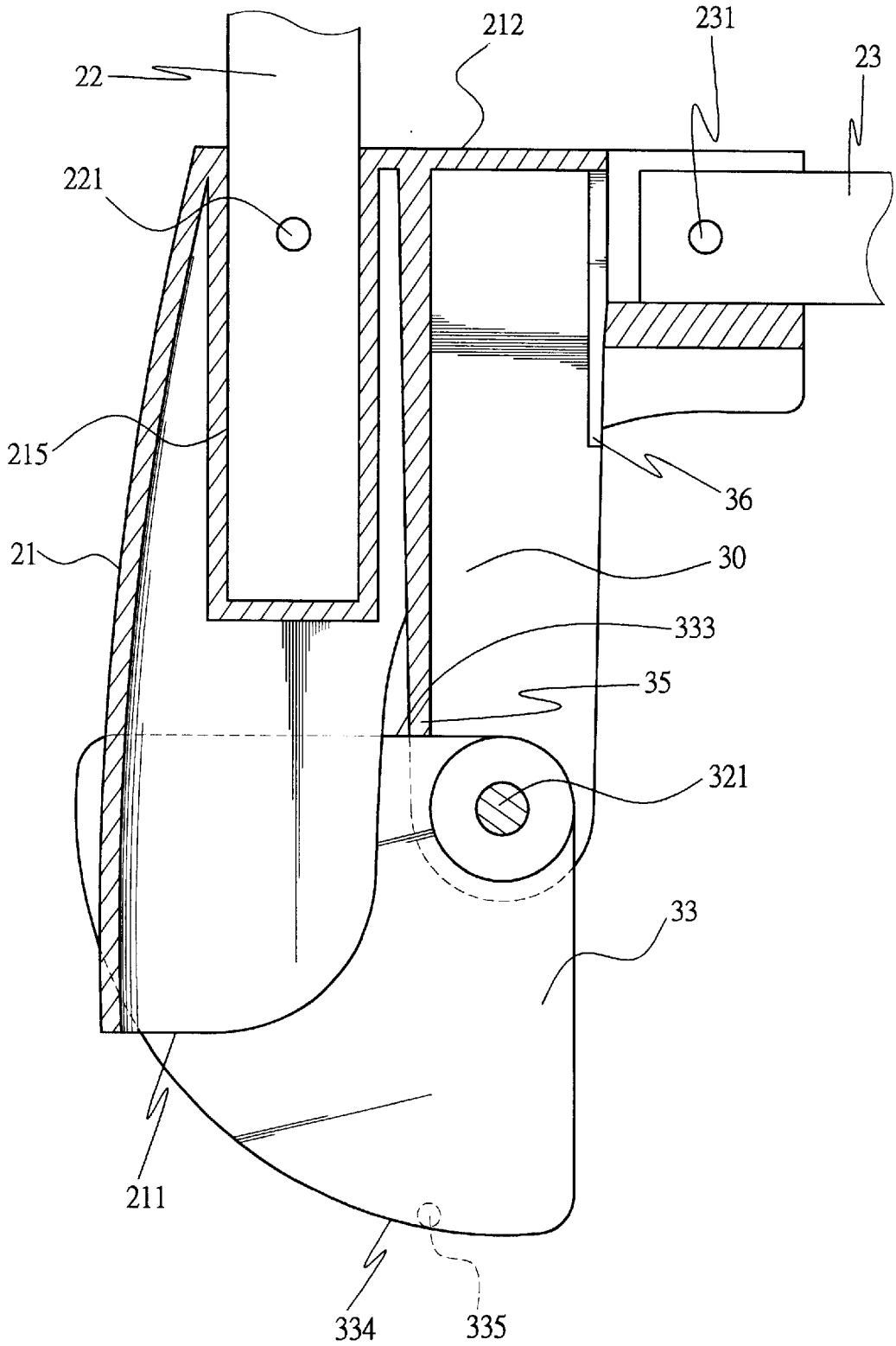
FIG. 6 is a sectional view indicating that the wobbler is stopped from further leftward rotation.
Figure 7:
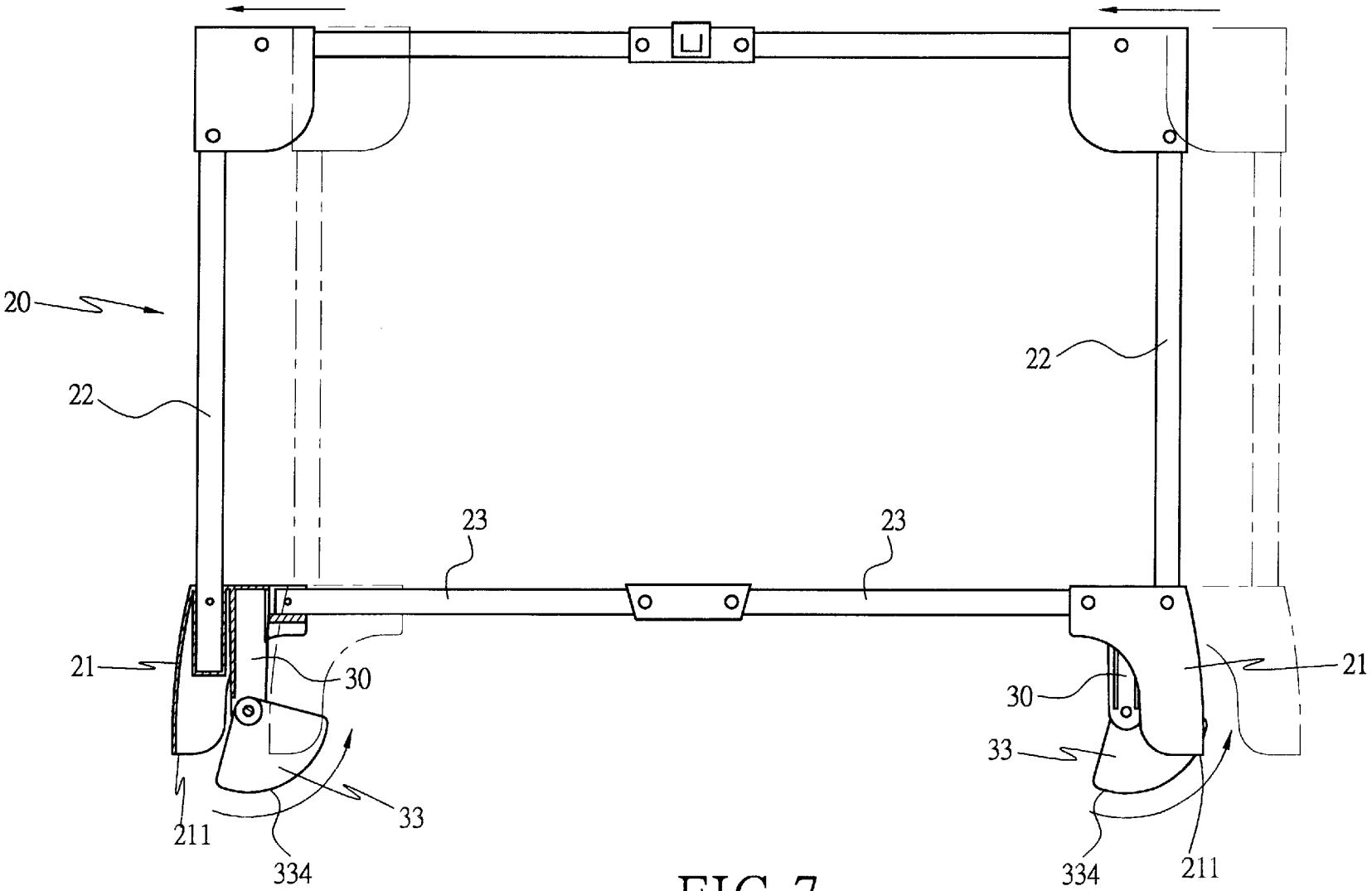
FIG. 7 is an elevational view to show the cradle of the present invention in operation.

Referring to FIGS. 4 and 5, before operation, the oscillators 33 under the four lower corners of the cradle 20 face downward and their aprons 334 partially rest on the ground. When the cradle 20 swings to the left (as shown in FIG. 7), the oscillators rotate to the right and will be stopped from further rightward rotation by the lateral walls 35 of the extensions 31 at the right side of the cradle 20. Contrarily, if the cradle 20 is swung to the right, the oscillators 33 will rotate to the left and be stopped from further leftward rotation by the lateral walls 35 of the extensions 31 at the left side of the cradle 20 (as shown in FIG. 6). This arrangement aims to prevent the cradle 20 from instability or toppling over.

Figure 8:
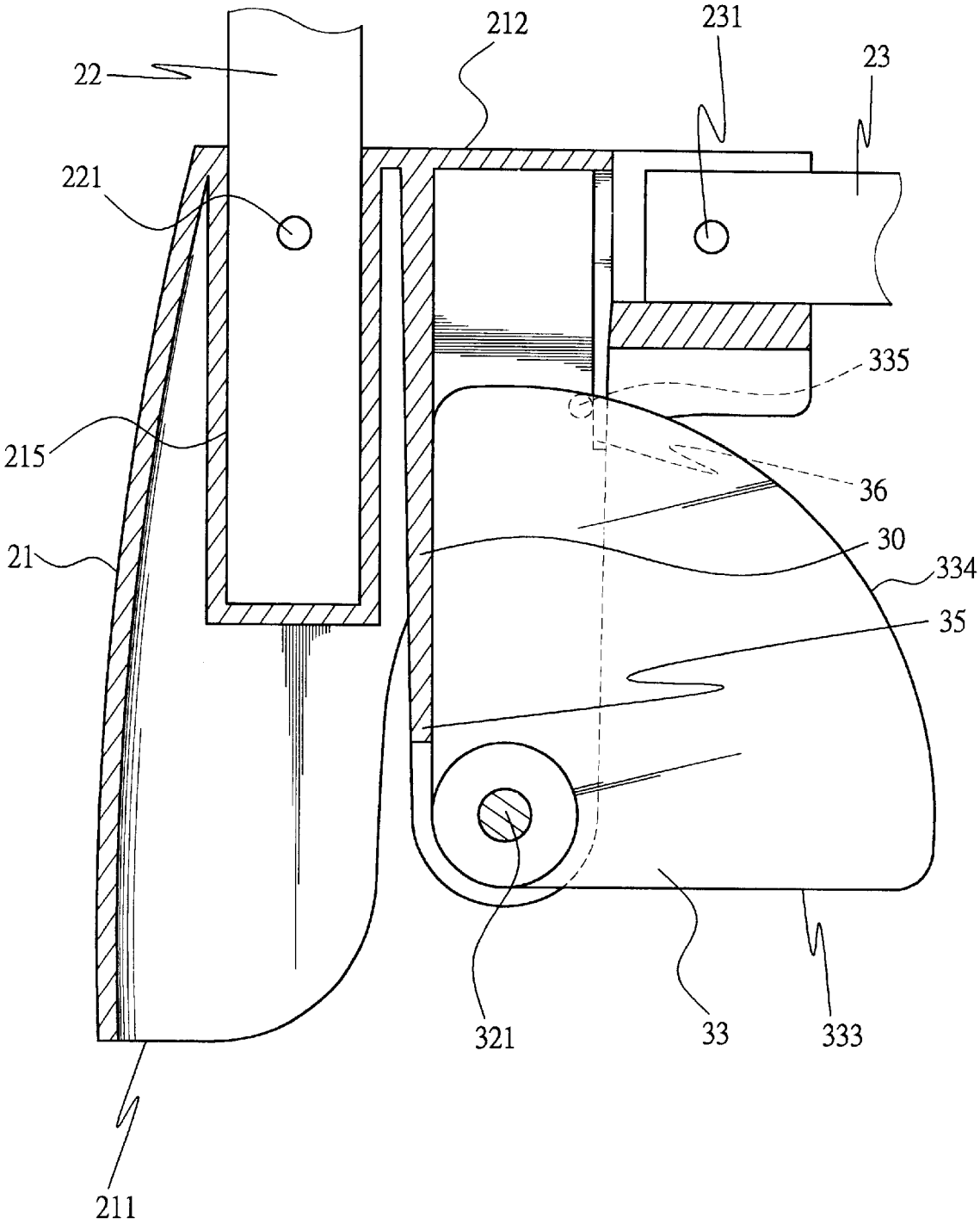
FIG. 8 is a sectional view to show the wobbler fixed into the L-shaped foot means.

Referring to FIG. 8, when the cradle 20 is not to sway and/or not in use, the user may rotate all the oscillators inward and collapse them into the extensions 31. The projections 335 of the oscillators are checked by the elastic plates 36 of the extensions 31 from rotation and the vertical portions 211 of the L-shaped foot means rest on the ground. It is understood that the oscillators are readily released down from the elastic plates 36 if the cradle 20 is to be swayed again.

Note that the specification relating to the above embodiment should be construed as exemplary rather than as the limitative of the present invention, with many variations and modification being readily attainable by a person of average skill in the art without departing from the spirit or scope thereof as defined by the appended claims and their legal equivalents.

I claim:

1. A sway device for a cradle comprising:

a plurality of sway members respectively disposed under a plurality of vertical posts of said cradle;

each sway member comprising:

an inverse L-shaped foot member which includes a vertical portion for enabling said foot member to stand on the ground, a transverse portion extending transversely from a top of the vertical portion having a pair of grooved branches perpendicular to each other for allowing a pair of transverse rods on a lower portion of said cradle to pivot and a vertical cavity in the top of the vertical portion for securing one of said vertical posts of said cradle;

a wobbler member extending downward from an underside of the transverse portion of said foot member, said wobbler member including a hollow interior extension integrated with the transverse portion of said foot member, a lug at the lower end of the extension, a plurality of longitudinal ribs on opposite outer surfaces of the extension, a lateral wall and an elastic plate positioned opposite to the lateral wall;

a sector shaped oscillator having an angled portion pivoting on the lug of said extension by a rivet, a pair of lateral sides, an arcuate apron for enabling the cradle to partially stand on the ground, a plurality of arcuate ribs concentric with the apron, a plurality of radial ribs and a projection at an outer surface of the apron, whereby said oscillator is rotatable on said lug and limited by the lateral wall of said hollow interior extension when said cradle is swayed.

2. The sway device as recited in claim 1 wherein said elastic plate of said hollow interior extension checks said projection of said apron to prevent said oscillator from rotation.

* * * * *